US011391078B2

(12) United States Patent
Collene

(10) Patent No.: US 11,391,078 B2
(45) Date of Patent: Jul. 19, 2022

(54) BLADE HINGE ASSEMBLY WITH CLOSURE MECHANISM

(71) Applicant: Mansfield Engineered Components, Inc., Mansfield, OH (US)

(72) Inventor: James J. Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 18 days.

(21) Appl. No.: 16/942,779

(22) Filed: Jul. 30, 2020

(65) Prior Publication Data

US 2021/0032917 A1 Feb. 4, 2021

Related U.S. Application Data

(60) Provisional application No. 62/880,635, filed on Jul. 30, 2019.

(51) Int. Cl.

| | |
|---|---|
| ***E05F 1/12*** | (2006.01) |
| ***E05D 5/06*** | (2006.01) |
| ***E05D 11/10*** | (2006.01) |
| ***F24C 15/02*** | (2006.01) |
| ***D06F 39/14*** | (2006.01) |
| ***D06F 58/20*** | (2006.01) |

(52) U.S. Cl.

CPC ..... *E05F 1/1246* (2013.01); *D06F 39/14* (2013.01); *D06F 58/20* (2013.01); *E05D 5/06* (2013.01); *E05D 11/1014* (2013.01); *F24C 15/023* (2013.01); *E05Y 2900/30* (2013.01); *E05Y 2900/308* (2013.01); *E05Y 2900/312* (2013.01)

(58) Field of Classification Search

CPC ..... E05F 1/1246; E05F 1/1253; E05F 1/1261; E05D 11/1014; E05D 11/1021; E05D 11/1028; E05D 11/105; E05D 11/1065; F24C 15/023

See application file for complete search history.

(56) References Cited

U.S. PATENT DOCUMENTS

| | | | | |
|---|---|---|---|---|
| 5,784,758 | A | 7/1998 | Carrick | |
| 6,393,664 | B1 | 5/2002 | Habegger et al. | |
| 6,766,563 | B2 * | 7/2004 | Lee | E05F 1/1261 16/335 |
| 7,134,169 | B2 | 11/2006 | Habegger et al. | |
| 8,925,542 | B2 | 1/2015 | White et al. | |
| 9,080,365 | B2 * | 7/2015 | Collene | E05F 5/02 |

(Continued)

OTHER PUBLICATIONS

Photograph of "Cabinet Hinge", Printed Jul. 2019, Product Introduction Date unknown.

*Primary Examiner* — Jeffrey O'Brien
(74) *Attorney, Agent, or Firm* — Fay Sharpe LLP

(57) ABSTRACT

A household appliance hinge includes a mounting portion and a mounting tab including a cam profile. A door mounting lever is pivotally connected to the mounting tab of the mounting portion. A spring-biased control system is connected to the door mounting lever and includes a spring-biased cam follower system including a cam follower that: (i) engages the cam profile in an engagement position and for all positions of the door mounting lever between the engagement position and a first operative position; and, (ii) separates from the cam profile for all positions of said door mounting lever located between the engagement position and a second operative position. The hinge is self-latching.

20 Claims, 10 Drawing Sheets

(56) References Cited

U.S. PATENT DOCUMENTS

| | | | | |
|---|---|---|---|---|
| 9,095,214 | B2 * | 8/2015 | White | A47B 96/00 |
| 9,121,211 | B1 * | 9/2015 | White | E05F 5/02 |
| 10,082,298 | B2 * | 9/2018 | White | E05F 3/20 |
| 10,295,194 | B2 * | 5/2019 | SirLouis | E05F 1/1261 |
| 10,451,291 | B2 * | 10/2019 | White | E05F 5/02 |
| 10,538,950 | B2 | 1/2020 | Collene | |
| 10,724,284 | B2 | 7/2020 | Collene | |
| 2011/0316401 | A1 | 12/2011 | Cummins et al. | |
| 2018/0216832 | A1 * | 8/2018 | White | E05F 5/02 |
| 2019/0353353 | A1 * | 11/2019 | White | E05F 3/20 |
| 2020/0271372 | A1 * | 8/2020 | Fei | F25D 23/028 |
| 2020/0332582 | A1 * | 10/2020 | Collene | E05F 1/1261 |
| 2021/0265764 | A1 * | 8/2021 | Hachadorian | H01R 13/5213 |

* cited by examiner

BLADE HINGE ASSEMBLY WITH CLOSURE MECHANISM

CROSS-REFERENCE TO RELATED APPLICATION

This application claims priority from and benefit of the filing date of U.S. provisional application Ser. No. 62/880,635 filed Jul. 30, 2019, and the entire disclosure of said provisional application is hereby expressly incorporated by reference into the present disclosure.

BACKGROUND

In certain household appliances, hinges are used to connect a door pivotally to a body or other structure that defines an interior chamber or space such that the door selectively opens and closes an access opening that leads to the interior chamber. Typically, at least two hinges are used and allow the door to pivot about a pivot axis between a closed position where the door covers and blocks the access opening and an opened position where the door is spaced from the access opening to allow access to the interior chamber through the access opening.

Often, a latch that is separate from the hinges is used to secure the door in its closed position. The use of a latch that is separate from the hinges can be suboptimal in that the latch is an added component that must be assembled and installed, the latch requires a mounting location on the appliance, and the latch must be relocated if the direction that the door pivots is altered such as when an appliance door is reversed to pivot about a pivot axis located adjacent a second side of the appliance body instead of an opposite first side of the appliance body. A separate latch can increase the cost of the appliance, in terms of parts and labor, and can increase complexity of assembly in that the latch must be installed, adjusted, and/or tested during the assembly process.

Additionally, for certain appliances such as clothes dryers and other applications, it is desirable that the hinge be completely unbiased or unrestrained so as to be freely pivotable over a maximum possible angular arc, except when the door is closed or nearly closed. In such applications, it is desirable that any biasing or latch mechanism be completely disengaged and inoperative to allow the door to pivot freely bidirectionally except when the door is pivoted to or near its closed position.

Accordingly, a need has been identified for a hinge that addresses the above concerns and others while providing better overall results.

SUMMARY

In accordance with one aspect of the present development, a household appliance hinge includes a mounting portion comprising a base adapted to be connected to an appliance body and a mounting tab that projects outwardly from the base. The mounting tab includes a peripheral edge and a pivot aperture. A cam profile is defined in said peripheral edge. The hinge assembly also includes a door mounting lever pivotally connected to the mounting tab of the mounting portion by a pivot fastener that is inserted in the pivot aperture of said mounting tab, wherein the door mounting lever pivots angularly and bi-directionally about a pivot axis in an opening direction and in an opposite closing direction and wherein said door mounting lever moves between a first operative position, a second operative position, and an engagement position located between said first operative position and said second operative position. A spring-biased control system is connected to the door mounting lever. The control system includes a spring-biased cam follower system including a cam follower that: (i) engages said cam profile in said engagement position and for all positions of said door mounting lever between said engagement position and said first operative position; and, (ii) separates from said cam profile for all positions of said door mounting lever located between said engagement position and said second operative position.

In accordance with another aspect of the present development, a household appliance includes a body and a door pivotally connected to the body by first and second hinge assemblies, wherein at least one of the hinge assemblies comprises a mounting portion comprising a base connected to the appliance body and a mounting tab that projects outwardly from the base. The mounting tab includes a peripheral edge and a pivot aperture. A cam profile is defined in said peripheral edge. The hinge assembly also includes a door mounting lever connected to the door. The door mounting lever is pivotally connected to the mounting tab of the mounting portion by a pivot fastener that is inserted in the pivot aperture of said mounting tab, wherein the door mounting lever pivots angularly and bi-directionally about a pivot axis in an opening direction and in an opposite closing direction and wherein said door mounting lever moves between a first operative position corresponding to a closed position of the door, a second operative position corresponding to an opened position of the door, and an engagement position located between said first operative position and said second operative position. A spring-biased control system is connected to the door mounting lever. The control system includes a spring-biased cam follower system including a cam follower that: (i) engages said cam profile in said engagement position and for all positions of said door mounting lever between said engagement position and said first operative position; and, (ii) separates from said cam profile for all positions of said door mounting lever located between said engagement position and said second operative position.

DETAILED DESCRIPTION

Figure 1:
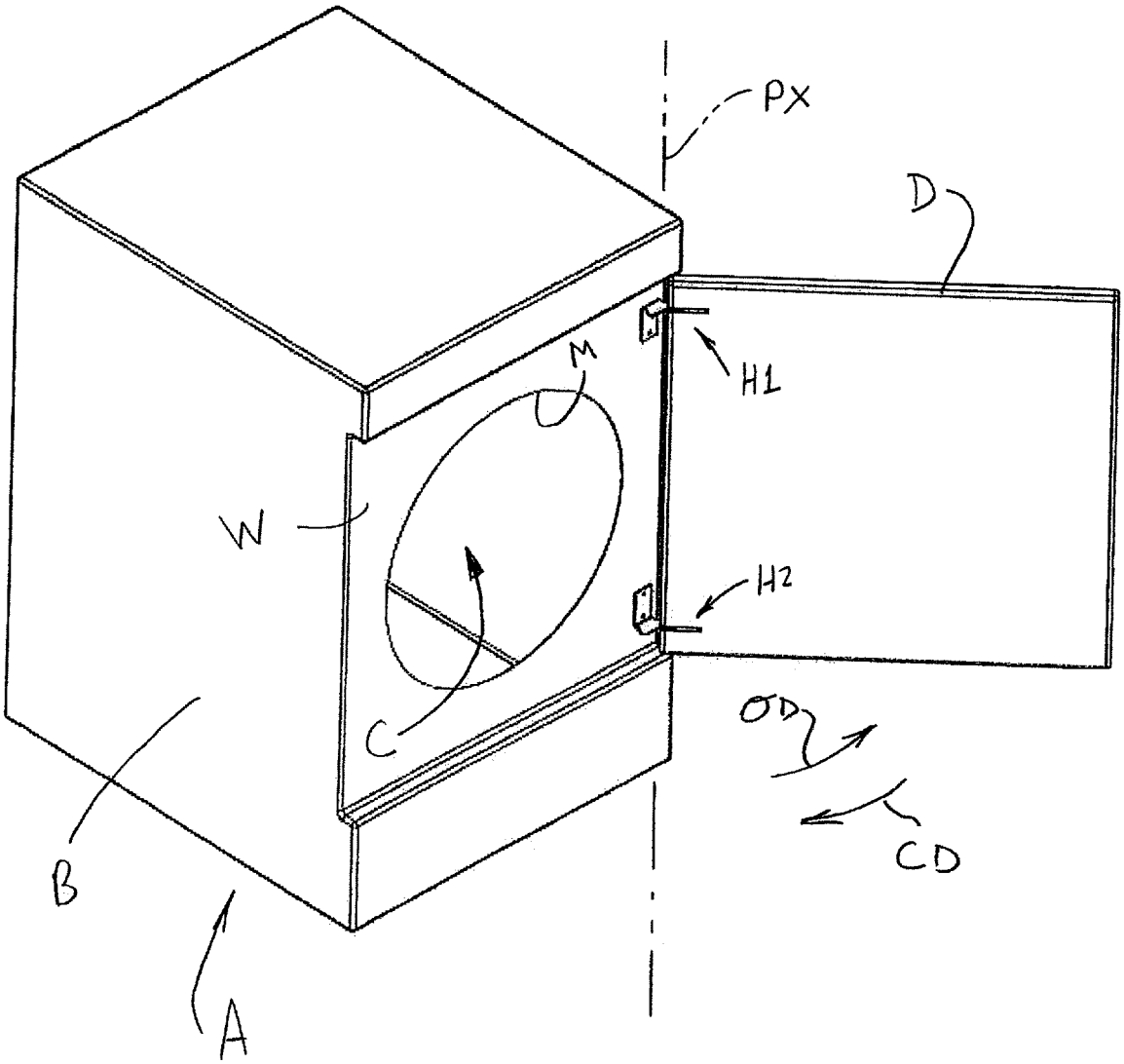
FIG. 1 illustrates a household appliance including first and second hinge assemblies each provided in accordance with an embodiment of the present disclosure, with a side-swing door of the appliance located in an opened position.
Figure 2:
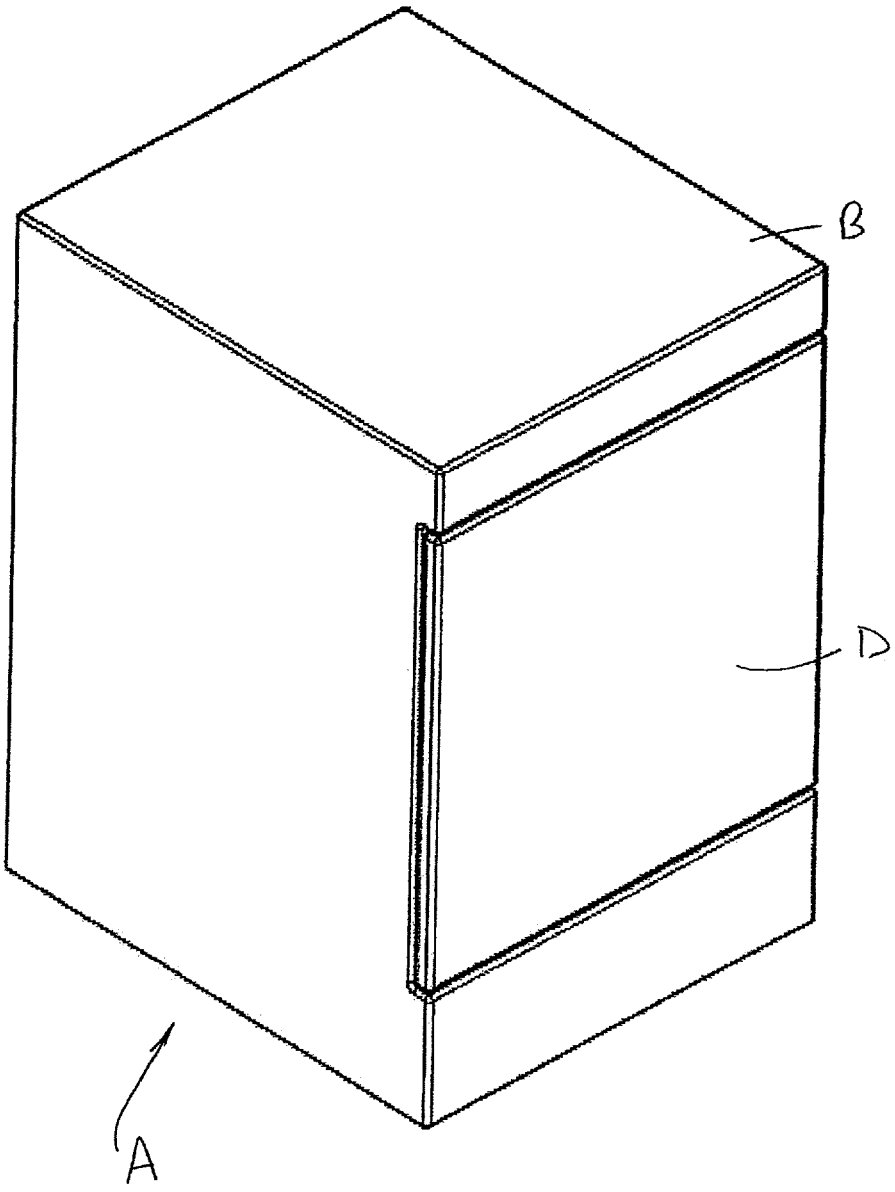
FIG. 2 shows the appliance of FIG. 1 with its door in a closed position.
Figure 3:
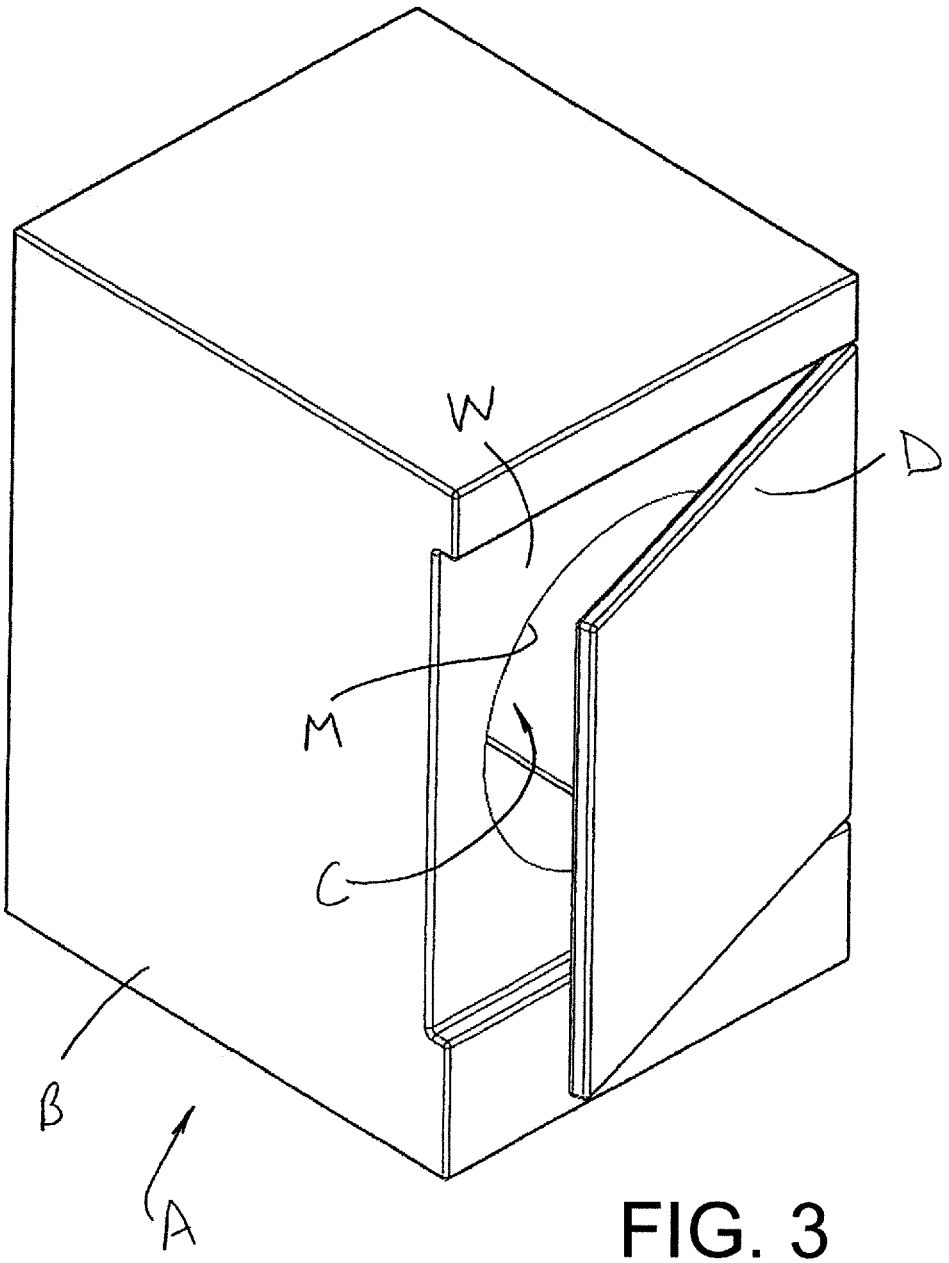
FIG. 3 shows the appliance of FIG. 1 with its door in an intermediate position or engagement position located between the opened and closed positions.
Figure 4:
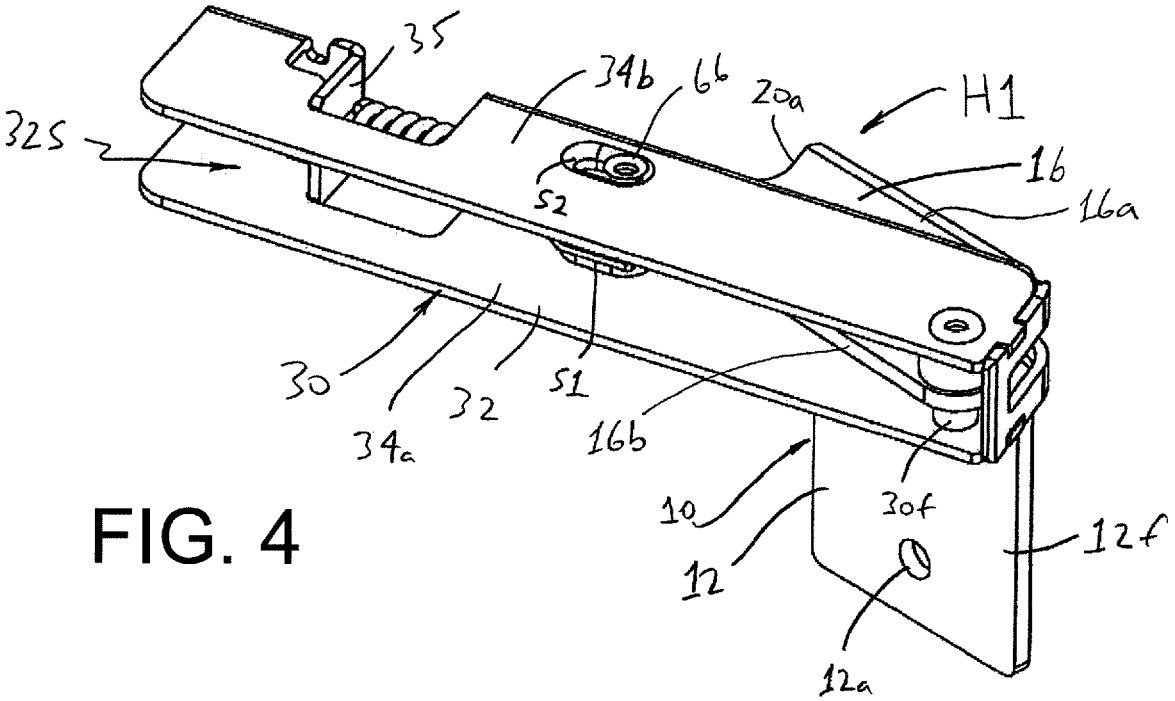
FIG. 4 is an isometric view of the first (upper) blade hinge assembly according to the illustrated embodiment of the present disclosure in its engagement position corresponding to the FIG. 3 position of the appliance door (in the illustrated example, the second (lower) blade hinge assembly of the appliance of FIG. 1 is shown herein as mirror image of the first (upper) hinge assembly, but it need not be a mirror image and need not be provided in accordance with an embodiment of the present disclosure and can instead be a known hinge)
Figure 5:
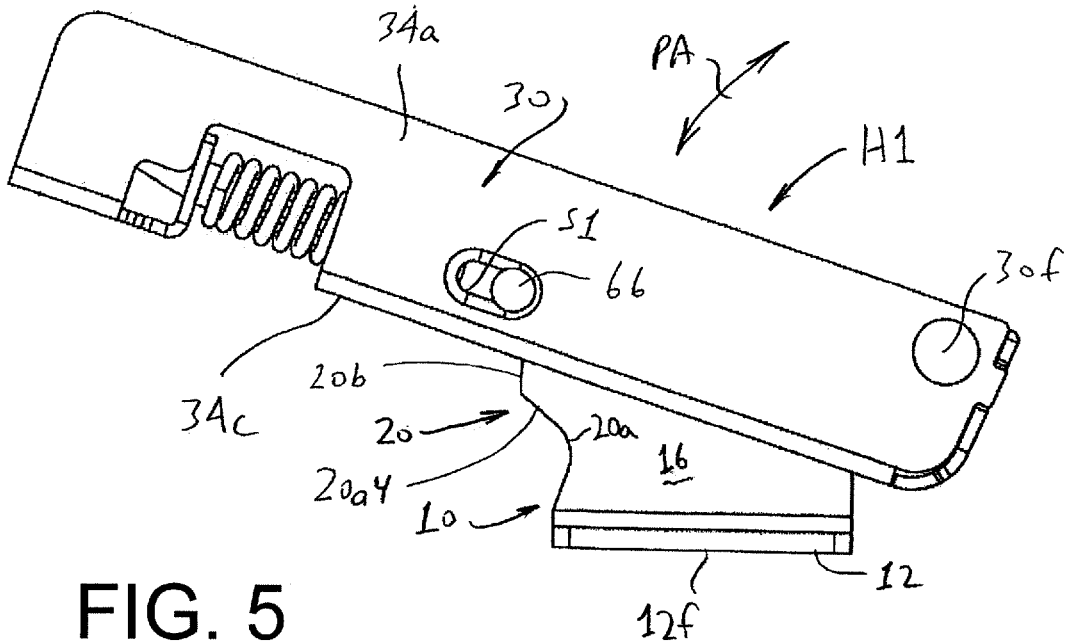
FIG. 5 is a bottom view of the first blade hinge assembly of FIG. 4.

FIGS. 1-3 show an appliance A including first and second "blade" or "blade-type" hinges or hinge assemblies H1,H2 each provided in accordance with an embodiment of the present disclosure, with a side-swing door D of the appliance located in an opened position. More particularly, the appliance A comprises a body B including a washing chamber, drying chamber, cooking chamber, or other internal appliance chamber C defined therein for washing or drying clothing, cooking food, or otherwise processing items. The appliance A further comprises a door D that is pivotally connected to a wall W of the appliance body B (shown as the front wall W), adjacent to an open access opening or mouth M of the chamber C that provides access to the chamber C. The door D pivots or swings angularly and bi-directionally about the pivot axis PX in an opening direction OD and an opposite closing angular direction CD about the pivot axis PX between an opened position (FIG. 1) and a closed position (FIG. 2), through multiple intermediate positions such as the intermediate position shown in FIG. 3 (the position of FIG. 3 is sometimes referred to herein as the engagement position as explained below). The door D pivots in response to manual input or motorized input exerted directly or indirectly on the door D. When in its opened position as shown in FIG. 1, the door D is moved away from the chamber mouth M to allow access to the mouth M and chamber C for loading and unloading. When in its closed position, the door D is moved adjacent the wall W and covers the chamber mouth M to block access to the mouth M and chamber C such as is typically desired during use of the appliance or during periods of inactivity.

As shown in FIG. 1, the door D is pivotally connected to the body B by first and second hinge assemblies H1,H2, at least one of which is formed in accordance with an embodiment of the present development. In the case where only one of the hinge assemblies H1,H2 is provided in accordance with the present development, the other hinge assembly can be conventional, such as a simple pivot pin or the like. In the case wherein both the first and second hinge assemblies H1,H2 are provided in accordance with an embodiment of the present development, they are preferably provided as mirror-image structures with respect to each other, which allows the first and second hinge assemblies H1,H2 to be used for a door D that pivots open from either the left side of the appliance or the right side of the appliance simply by swapping the location of the hinges H1,H2 with respect to each other and installing the hinge assemblies on the opposite lateral side of the appliance body as compared to the position shown in FIG. 1. Furthermore, the appliance illustrated in FIG. 1 includes a side-swing door D that pivots about a vertical or near-vertical pivot axis PX such that the first and second hinge assemblies can be referred to respectively as "upper" and "lower" hinges. Alternatively, the appliance can include a door D that pivots about a horizontal pivot axis using at least one hinge assembly H1,H2 provided in accordance with the present development, in which case the first and second hinge assemblies are located on opposite left and right sides of the chamber mouth M, typically adjacent the left and right lateral sides of the body B. The wall W can be any wall of the body B such as a vertical front wall (as shown), a vertical side wall, a horizontal wall such as a horizontal top wall, or an angled wall that is neither horizontal nor vertical.

FIGS. 4-7C shows a first embodiment of the first hinge assembly H1 provided in accordance with the present development. The second hinge assembly H2 can be similar or identical to the first hinge assembly H1 or can be a mirror image of the structure of the first hinge assembly H1. Alternatively, the second hinge assembly H2 can be formed in accordance with an alternative embodiment of the present development or it can be a conventional hinge structure or simple pivot pin or stud or other structure that supports the door D and allows the door to pivot about the pivot axis PX.

The hinge assembly H1 comprises a stationary blade or leaf mounting portion 10 including a base 12 adapted to be connected to a mounting structure or location such as the front wall W or other part of the appliance body B. As shown herein, the base 12 of the mounting portion 10 comprises a flat structure 12*f* including one or more mounting apertures 12*a* defined therein which can be holes (as shown), open or closed slots, or other openings that are adapted to receive screws, rivets, or other mounting fasteners that are engaged with the base and appliance body B to fixedly secure the base 12 to the appliance body B. Additionally or alternatively, the flat structure 12*f* or other part of the base 12 can include slots, projections, or other structures for mating with corresponding structures on the appliance body B. Base 12 can alternatively or additionally comprise curved, angled, and/or other structures in place of or in addition to the flat portion 12*f* as required to lie adjacent or otherwise fit together with the appliance body B for mounting the base 12 thereon.

Figure 6:
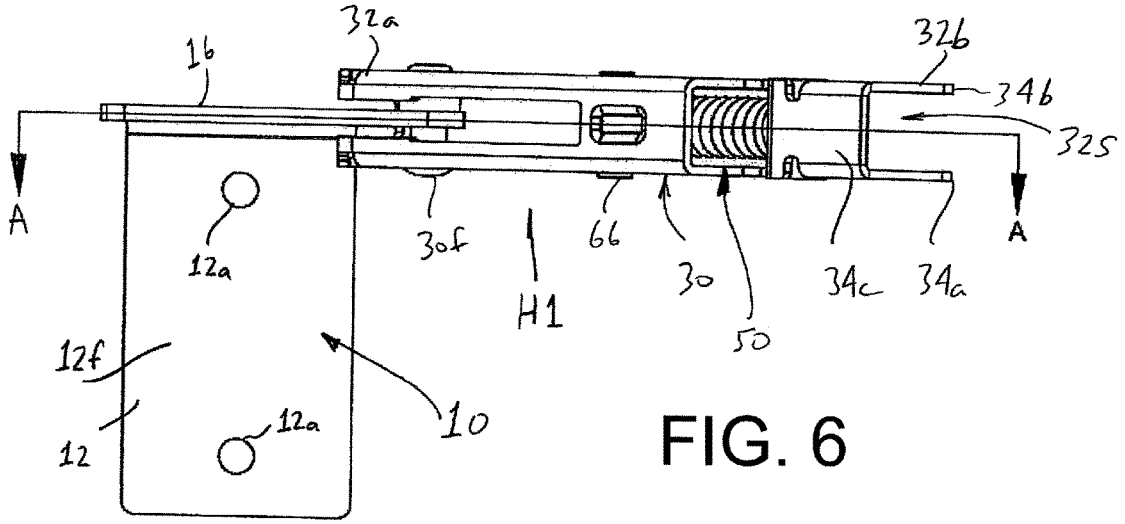
FIG. 6 is front elevational view of the first blade hinge assembly of FIG. 4 in its opened (second operative) position corresponding to the opened position of the appliance door as shown in FIG. 1.
Figure 6A:
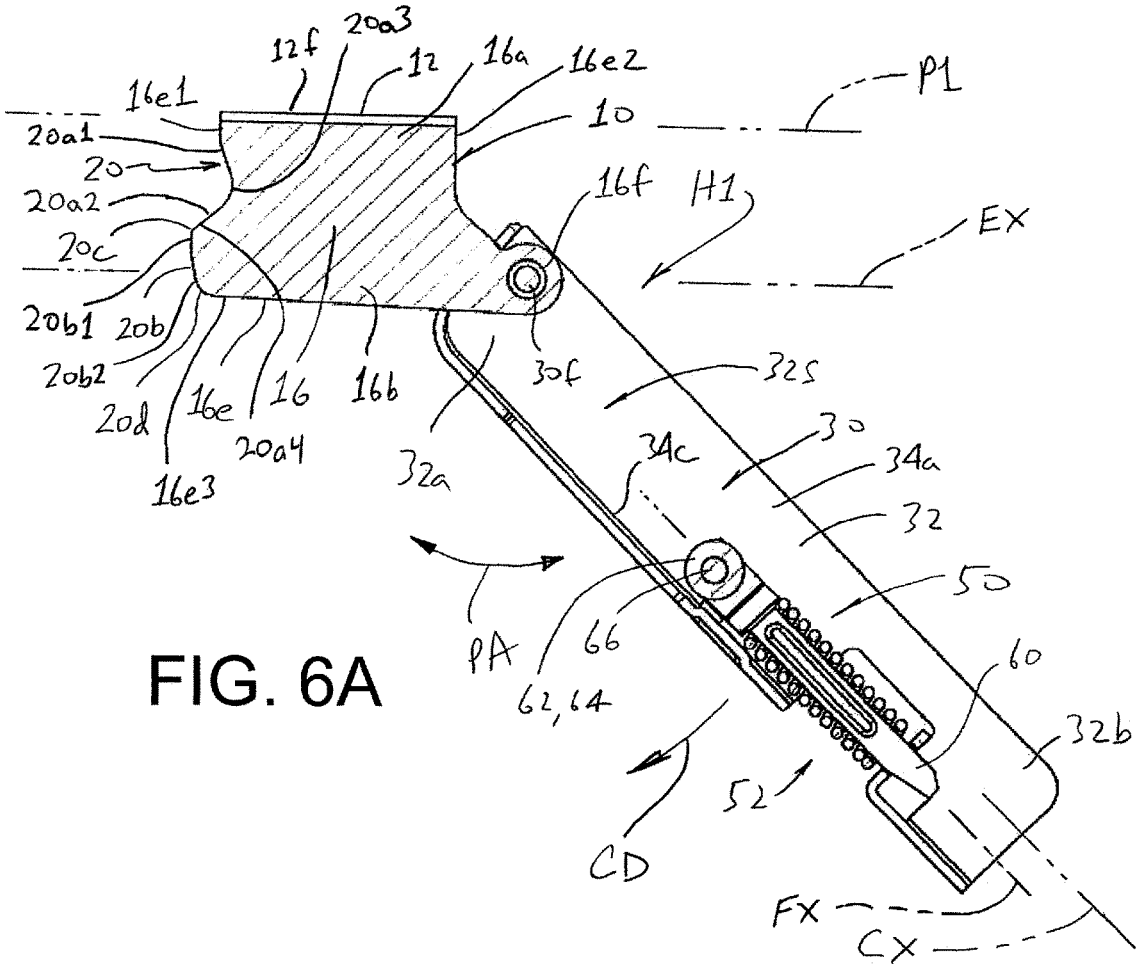
FIG. 6A is section view of the first blade hinge assembly as taken at line A-A of FIG. 6.

The mounting portion 10 further comprises a mounting tab 16 connected to and projecting outwardly from the base 12. As shown herein, the mounting tab 16 is transversely oriented relative to the base 12, such as perpendicularly as shown herein. The mounting tab includes an inner region 16*a* connected to and located adjacent the base 12 and includes an outer region 16*b* that is spaced from the inner region 16*a* and spaced outwardly away from the base 12. As shown in FIG. 6A, the mounting tab 16 comprises a peripheral edge 16*e* that extends from a first end 16*e*1 connected to the base 12 to a second end 16*e*2 also connected to the base 12. The stationary leaf 10, including the base 12 and the mounting tab 16 is preferably defined as a one-piece structure as a stamped steel or other metallic structure. Alternatively, the stationary leaf 10 can be manufactured as a metallic and/or polymeric one-piece or multi-piece structure using extrusion, injection molding, powdered metal, additive manufacturing, and/or any other suitable manufacturing process.

Referring particularly to FIG. 6A, at least part of the peripheral edge 16*e* defines a cam profile 20 including a concavely curved closing recess 20*a* that includes an inner end 20*a*1 located adjacent the base 12 (adjacent the inner portion 16*a* of the mounting tab 16). The closing recess 20*a* also includes an outer end 20*a*2 spaced outwardly from the inner end 20*a*1 and spaced outwardly away from the base 12. Between the inner and outer ends 20*a*1,20*a*2, the closing recess 20*a* comprises a concave internal or bottom region 20*a*3. The cam profile 20 further comprises an engagement surface 20*b* located adjacent the outer end 20*a*2 of the closing recess 20*a* and that extends outwardly away from the base 12 and outwardly away from the closing recess 20*a*. The engagement surface 20*b* can be smoothly convexly curved (as shown), flat, and/or otherwise shaped and includes an inner end 20*b*1 connected to the outer end 20*a*2 of the closing recess 20*a*. The cam profile 20 further comprises a convexly curved or angled peak 20*c* (FIG. 6A) that is defined at the intersection of the outer end 20*a*2 of the closing recess 20*a* with the inner end 20*b*1 of the engagement surface 20*b*. As noted, the inner end 20*a*1 of the closing recess 20*a* is located adjacent the base 12 and the outer end 20*a*2 of the closing recess 20*a* is spaced from the base 12 and connected to the engagement surface 20*b*. The engagement surface 20*b* extends outwardly away from the closing recess 20*a* to an outer end 20*b*2 of the engagement surface that defines a convexly curved engagement location or engagement corner 20*d* (FIG. 6A) where the outer end 20*b*2 of the engagement surface 20*b* joins into an adjacent outer portion 16*e*3 of the peripheral edge 16*e*. The distance between the closing recess 20*a* and the base 12 is less than the distance between the engagement surface 20*b* and the base 12 such that the closing recess 20*a* is located between the base 12 and the engagement surface 20*b*.

The mounting tab 16 further comprises a pivot aperture 16*f* defined therein, preferably at a location spaced-apart from the cam profile 20 and aligned with at least part of the engagement surface 20*b* on an engagement axis EX that passes through a center of the pivot aperture 16*f* and that lies parallel to a reference plane P1 in which the flat structure 12*f* of the base 12 extends.

The first hinge assembly H1 further comprises a door mounting lever 30 pivotally connected to the mounting portion 10 by a rivet, pin, bolt, screw, or other pivot fastener 30*f* that extends through the pivot aperture 16*f* of the mounting tab 16 of the mounting portion 10. The door mounting lever 30 is adapted to be connected to the appliance door D for pivotally connecting the appliance door D to the mounting portion 10 and thus to the appliance body B such that the door mounting lever 30 and door D move together in the opening and closing directions OD,CD about the pivot axis PX. In the illustrated embodiment, the door mounting lever 30 comprises a channel 32 including first and second spaced-apart side walls 34*a*,34*b* that are connected to each other by a front wall 34*c* that extends between and connects the side walls 34*a*,34*b*. The side walls 34*a*,34*b* can be parallel relative to each other as shown herein, with the front wall 34*c* being oriented perpendicularly to the side walls 34*a*,34*b*. A space 32S is defined between the side walls 34*a*,34*b* and the front wall 34*c*. The channel 32 is adapted to be fixedly secured the appliance door by any suitable fasteners or other structure. For example, the channel 32 can include one or more slots or apertures formed in the side walls 34*a*,34*b* and/or front wall 34*c* that receive screws, rivets, or other fasteners that are engaged with the appliance door D. Alternatively or additionally, the appliance door D includes a slot or other structure that is adapted to receive and retain the channel 32 with or without the use of fasteners, clips or the like to retain the channel 32 to the door and vice versa. The channel 32 is preferably defined as a one-piece structure as a stamped steel or other metallic structure. Alternatively, the channel 32 can be manufactured as a one-piece or multi-piece metallic and/or polymeric structure using extrusion, injection molding, powdered metal, additive manufacturing, and/or any other suitable manufacturing process.

The channel 32 is elongated along a channel axis CX (FIG. 6A) and includes opposite first (inner) and second (outer) ends 32*a*,32*b* that are spaced-apart from each other along the channel axis CX. The first end 32*a* is pivotally connected to the mounting tab 16 of the mounting portion 10 by the pivot fastener 30*f* that extends through and between first and second channel mounting apertures that are defined respectively in the first and second side walls 34*a*,34*b* and that are aligned with each other on opposite sides of the channel space 32S. As shown herein the pivot fastener 30*f* comprises a rivet, but other suitable fasteners can be used such as a pin, bolt/nut combination, screw, stud, or the like. The channel 32 is therefore adapted to pivot relative to the mounting portion 10 on an arc PA in first and second opposite angular directions about a pivot axis PX defined by the pivot fastener 30*f*. The pivot axis PX can be vertical, horizontal, or otherwise oriented when the hinge assembly H1 is in operative use. When used in connection with an appliance A that includes a side-swing door D as shown in FIGS. 1-3, the pivot axis PX is typically vertically oriented or approximately vertically oriented such as within 10 degrees of vertical. The hinge assembly H1 can alternatively be used with an oven door or other appliance door that pivot about a horizontal axis when moving between its opened and closed positions, in which case the hinge assembly is operatively installed such that the pivot axis PX is horizontally oriented.

The hinge assembly H1 further comprises a spring-biased control system 50 that controls the operative relationship between the stationary leaf mounting portion 10 and the door mounting lever 30 for at least some angular positions of the lever 30 relative to the mounting portion 10 on the pivot arc PA. More particularly, the control system 50 comprises a spring-biased cam follower system 52 operatively connected to the door mounting lever 30 that engages the cam profile 20 for certain angular positions of the door mounting lever 30 relative to the mounting portion 10 such that the cam profile 20 and cam follower system 52 cooperate with each other to apply certain forces on the door mounting lever 30 to provide the desired operational characteristics to the hinge assembly H1 as described in more detail below.

In the illustrated embodiment, the cam follower system 52 is located in the space 32S of the channel 32. The cam follower system 52 comprises a spring rod 60 that is slidably connected to the channel 32 of the lever 30 and that slidably reciprocates relative to the channel 32 in first and second opposite directions toward and away from the first and second ends 32*a*,32*b* of the channel on follower axis FX that is parallel to the channel axis CX. In the illustrated example, a portion of the front wall 34*c* of channel 32 is bent into the space 32S to define a mounting tab 35 including an aperture 35*a* therein. The spring rod 60 extends through and is slidable in the mounting tab aperture 35*a*. An outer end of the spring rod 60 is located between the mounting tab 35 and the second (outer) end 32*b* of the channel 32. The opposite inner end of the spring rod 60 is located between the mounting tab 35 and the first (inner) end 32*a* of the channel 32.

The inner end of the spring rod 60 includes a cam follower 62 connected thereto and/or formed as a part thereof. The follower 62 is movably supported relative to or movably connected to the channel 32 of the lever 30. The follower 62 is adapted to engage and move along the cam profile 20 for at least certain positions of the door mounting lever 30 relative to the mounting portion 10. The follower 62 can be provided by and/or include a tip or inner end of the spring rod 60, itself, and/or can comprise a polymeric or other slide member connected to or defined as part of the spring rod 60. As shown herein, the follower 62 preferably comprises a polymeric or other roller 64 that is rotatably connected to the inner end of the spring rod 60 and that is adapted to rotate about an axis of rotation that is oriented parallel to the pivot axis PX.

In the illustrated embodiment, the inner end of the spring rod 60 comprises a bifurcated leg structure or yoke 60*y* (FIG. 7D) including spaced apart legs between which the roller 64 is located and supported for rotation by a follower support shaft 66 which can be provided by any suitable elongated member such as a pin, bolt, rivet (as shown), or the like. The first and second side walls 34*a*,34*b* of the channel 32 respectively include first and second elongated slots S1,S2 that are aligned with each other and elongated along the channel axis CX. The opposite first and second ends of the follower support shaft 66 are respectively engaged with the first and second elongated slots S1,S2 and the follower shaft 66 extends through the channel space 32S between the channel side walls 34*a*,34*b*, and also extends through the legs of the yoke 60*y* and through the roller 64. As such, the roller 64 is rotatably supported in the channel space 32S on the shaft 66 at the inner end of the spring rod 60. The yoke 60*y* and roller 64 are captured in the channel space 32S by the engagement of the follower support shaft 66 in the first and second elongated slots S1,S2. The spring rod 60, including the yoke 60*y* and roller 64 rotatably connected thereto, is adapted to linearly reciprocate in the channel space 32S in first and second opposite directions D1,D2 (FIG. 7D) toward and away from the pivot axis PX, respectively, as permitted by the sliding engagement of the follower support shaft 66 in the elongated slots S1,S2.

A spring 68 is operatively engaged with the spring rod 60 or otherwise operatively engaged with the follower 62 and exerts a biasing force on the spring rod 60 that urges the spring rod 60 and follower 62 (roller 64) in the first direction D1 toward the first (inner) end 32*a* of the channel (toward the pivot axis PX) to the maximum extent permitted by the sliding movement of the follower support shaft 66 in the elongated slots S1,S2 (referred to herein as the "extended position" of the spring rod 60). The spring rod 60 and follower 62 (roller 64) are selectively moveable in the direction D2 toward a retracted position. In particular, the spring rod 60 and follower 62 are selectively moveable in the second direction D2 away from the extended position toward the opposite second (outer) end 32*b* of the channel 32 (away from the pivot axis PX) against the biasing force of the spring 68 to the extent permitted by the sliding movement of the follower support shaft 66 in the elongated slots S1,S2.

Figure 7A:
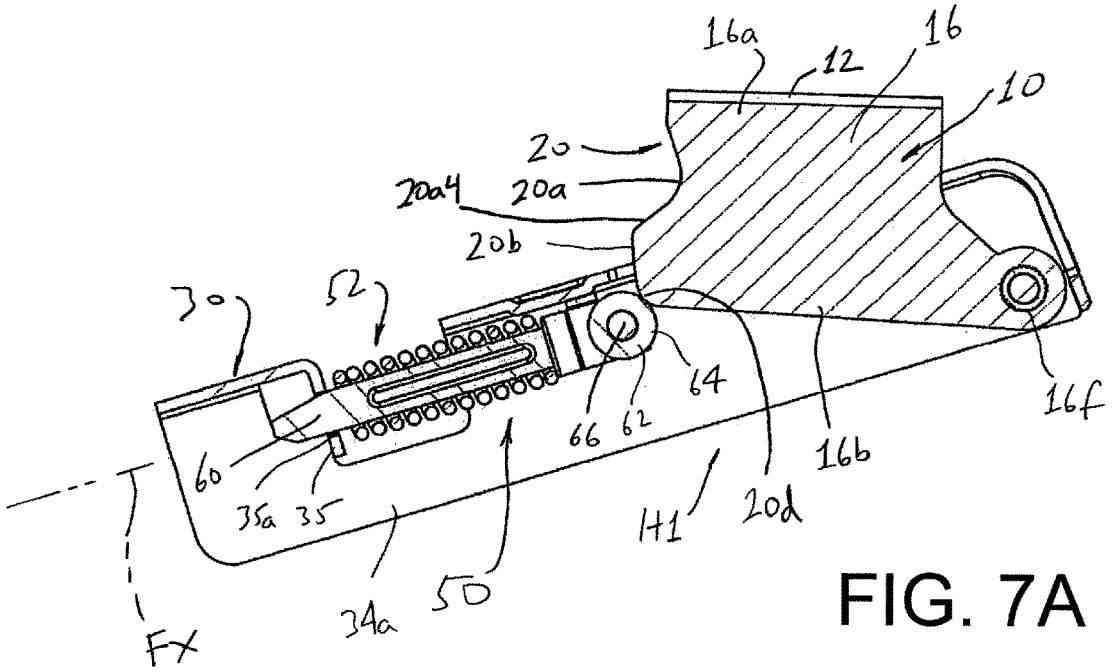
FIG. 7A is section view that is similar to FIG. 6A but shows the blade hinge assembly in its engagement position corresponding to the intermediate or engagement position of the appliance door as shown in FIG. 3.

In the embodiment of FIGS. 4-7C, the spring biased control system 50 comprises a helical compression coil spring 68 coaxially positioned about the spring rod 60 between the mounting tab 35 and the yoke 60*y*, but any other suitable spring and/or spring arrangement can be used instead to bias the spring rod 60 and follower 62 (roller 64) toward the extended position, such as a torsion spring, extension coil spring, or the like. For example, FIGS. 8 & 8A show an alternative embodiment H1' that is identical to the hinge assembly H1 except as otherwise shown and/or described herein, and similar structures are identified with similar reference numbers/characters that include a primed (') designation. Instead of the coaxial coil spring 68 and spring rod 60, the spring-biased control system 50' of the hinge assembly H1' comprises at least one torsion spring 68' operatively engaged between the channel 32' and the follower support shaft 66' or other part of the follower 62'. The torsion spring 68' comprises a first leg 68*a*' that is operatively engaged with the follower 62' such as being engaged with the follower support shaft 66' as shown herein. The torsion spring 68' further comprises a second leg 68*b*' that is operatively engaged with the channel 32' of the lever 30' such as with a tab 35' that projects into the space 32S' from the front wall 34*c*' or another fixed anchor structure of the channel 32'. As such, the torsion spring 68' acts to bias the follower 62' in the direction D1 toward the extended position as described above. As can be seen in FIG. 8A, the torsion spring 68' can comprises a double torsion spring with first and second helical coils and 69*a*',69*b*', wherein each coil 69*a*',69*b*' comprises the first and second legs 68*a*',68*b*' extending outwardly therefrom, but a single-coil torsion spring can be used instead.

Figure 9:
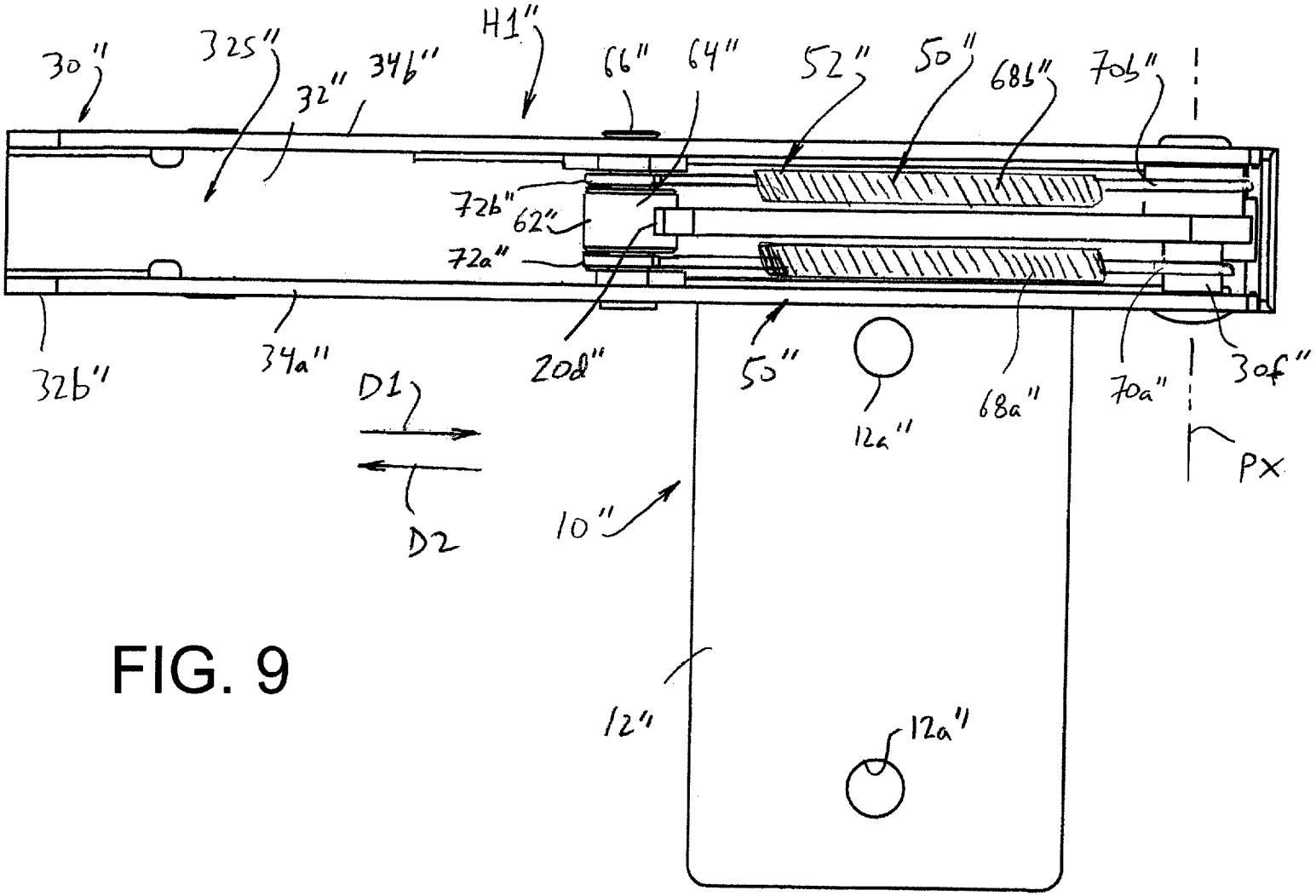
FIG. 9 is a front view of another alternative blade hinge assembly formed in accordance with the present development including one or more extension springs.

FIG. 9 shows another alternative embodiment H1" that is identical to the hinge assembly H1 except as otherwise shown and/or described herein, and similar structures are identified with similar reference numbers/characters that include a double-primed (") designation. Instead of the coaxial coil spring 68 and spring rod 60, the spring-biased control system 50" of the hinge assembly H1" comprises at least one extension spring such as the illustrated first and/or second helical coil springs 68*a*",68*b*" operatively engaged between the channel 32" and the follower support shaft 66" or other part of the follower 62" to bias the follower 62" (roller 64") in the first direction D1 toward its extended position. The springs 68*a*",68*b*" include respective hooks or loops at their opposite ends or are otherwise configured to be connected at their respective first (inner) ends 70*a*",70*b*" directly or indirectly to the channel 32". As shown herein, the inner end 70*a*",70*b*" of the respective spring 68*a*",68*b*" is indirectly connected to and operably engaged with the channel 32"/lever 30" through the pivot fastener 30*f*" or other structure (such as the mounting tab 16" or other part of the mounting portion 10") that is fixedly secured to the channel 32". The opposite, outer end 72*a*",72*b*" of the respective spring 68*a*",68*b*" is operatively indirectly engaged with the follower 62" such as by being engaged with the follower support shaft 66" as shown herein. As such, each extension spring 68*a*",68*b*" acts to bias the follower 62" in the direction D1 toward the extended position as described above. As noted, either one of the extension springs 68*a*",68*b*" can be provided without the other without departing from the scope and intent of the present development.

Regardless of the particular spring arrangement and structure used for the spring-biased control system 50,50',50", the roller 64 or other follower 62 is continuously biased toward its extended position. In at least one angular position of the door mounting lever 30 relative to the mounting tab 16 of the stationary leaf mounting portion 10, the cam profile 20 and cam follower 62 are engaged with each other and are operative and co-act with each other to induce a closing force or closing moment F1 (see FIGS. 7C & 8) in the door mounting lever 30 that urges the lever 30 toward its first operative (closed) position (FIG. 7C), corresponding to the closed position of the appliance door D as shown in FIG. 2. In particular, the outer portion 20*a*2 of the closing recess 20*a* of the cam profile 20 includes a sloped or inclined portion or surface 20*a*4 (FIG. 6A) adjacent the peak 20*c* that can be flat as shown and that extends inwardly toward the base 12 (toward the inner portion 16*a* of the mounting tab 16) as it extends deeper into the closing recess 20*a* toward the concave central portion 20*a*3 and that is otherwise conformed and dimensioned such that when the follower 62 is resiliently urged into contact therewith by the spring-biased control system 50,50',50", the spring-biased control system 50 induces the closing moment F1 in the door mounting lever 30 that urges the lever 30 and door D connected thereto toward the closed position. The hinge assembly H1 and/or appliance is configured such that when the appliance door D is in its closed position (FIG. 2), the hinge assembly H1 and the door mounting lever 30 are also in the closed (first operative) position (FIG. 7C) and the follower 62 remains in contact with the inclined portion 20*a*4 of the closing recess 20*a* such that the lever 30 and door D connected thereto are continuously urged in the closing direction by the closing moment F1, i.e., the follower 62 preferably does not seat in the bottom 20*a*3 of the closing recess 20*a* when the appliance door D is fully closed as would eliminate the closing moment F1).

Figure 7B:
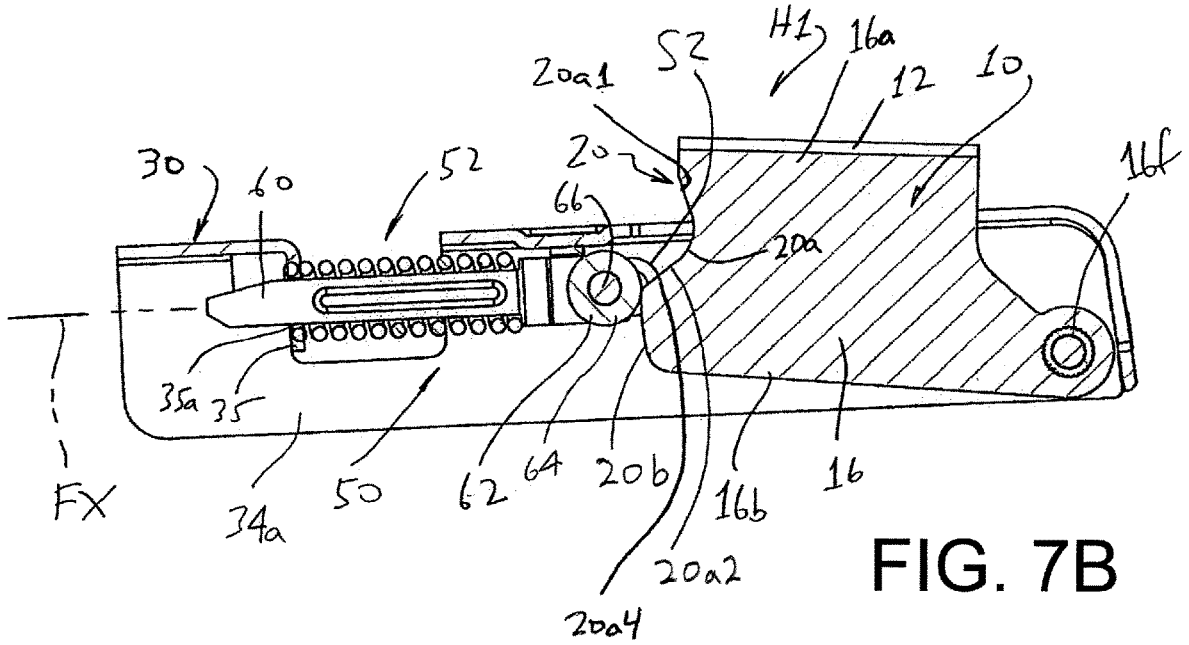
FIG. 7B is section view that is similar to FIG. 7A but shows the blade hinge assembly in its peak position where the cam roller is in contact with a peak defined between a closing recess and an engagement surface of a cam profile.
Figure 7C:
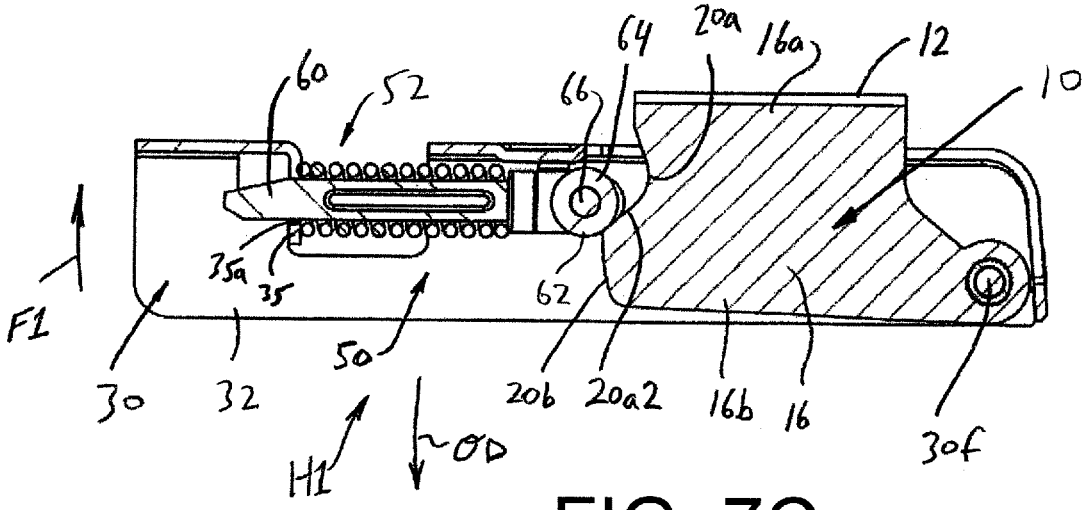
FIG. 7C is section view that is similar to FIG. 7A but shows the blade hinge assembly in its closed (first operative) position where the cam roller is in contact with the closing recess of a cam profile corresponding to the closed position of the appliance door as shown in FIG. 1.
Figure 8:
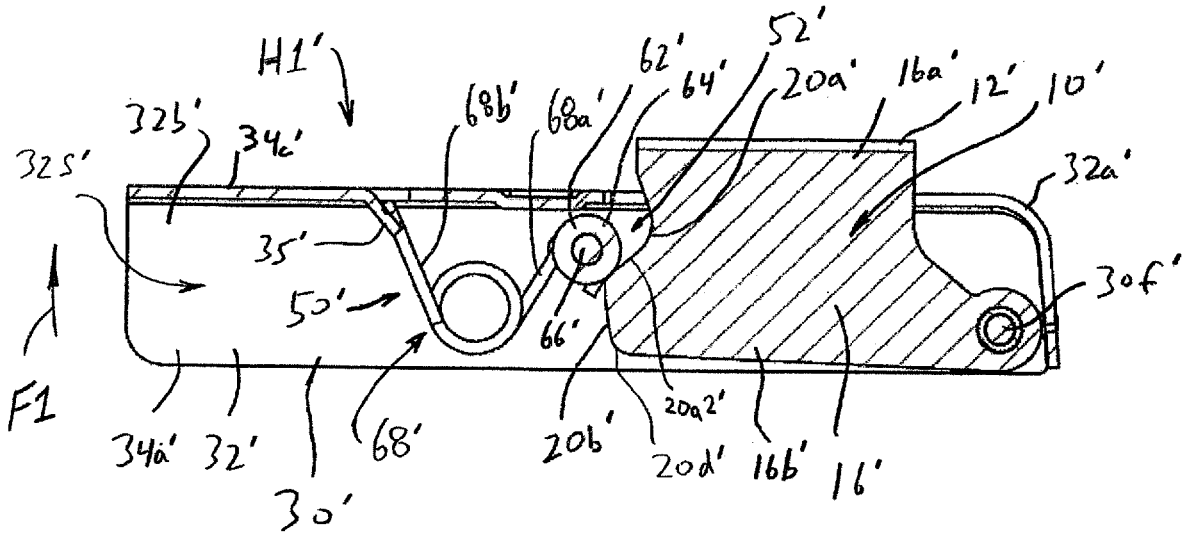
FIG. 8 is a section view that corresponds to FIG. 7C, but shows a blade hinge assembly formed in accordance with an alternative embodiment of the present development including a torsion spring.
Figure 7D:
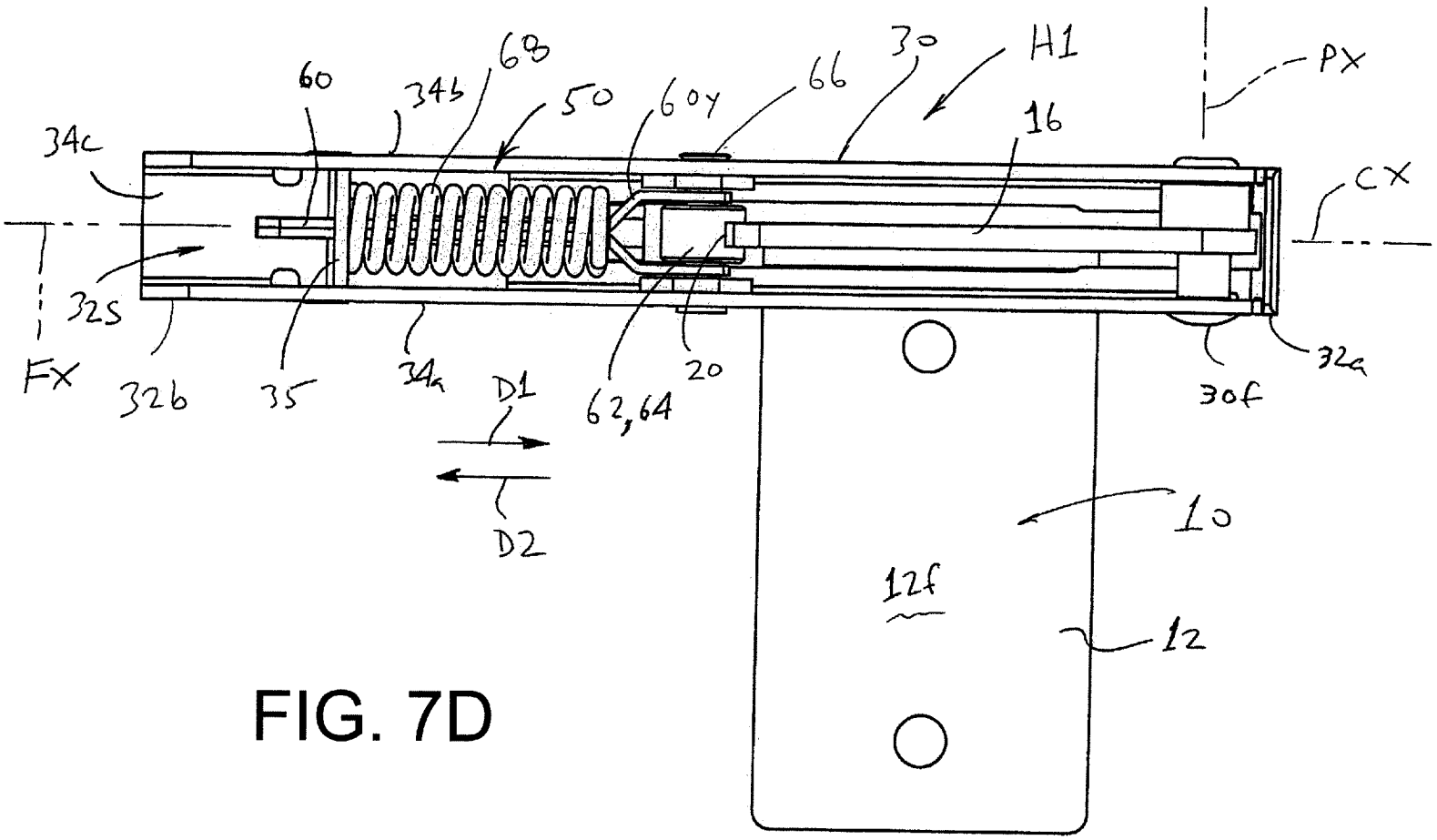
FIG. 7D is front elevational view of the first blade hinge assembly that is similar to FIG. 6 but shows the hinge assembly positioned in its closed (first operative) position corresponding to the closed position of the appliance door as shown in FIG. 2.
Figure 8A:
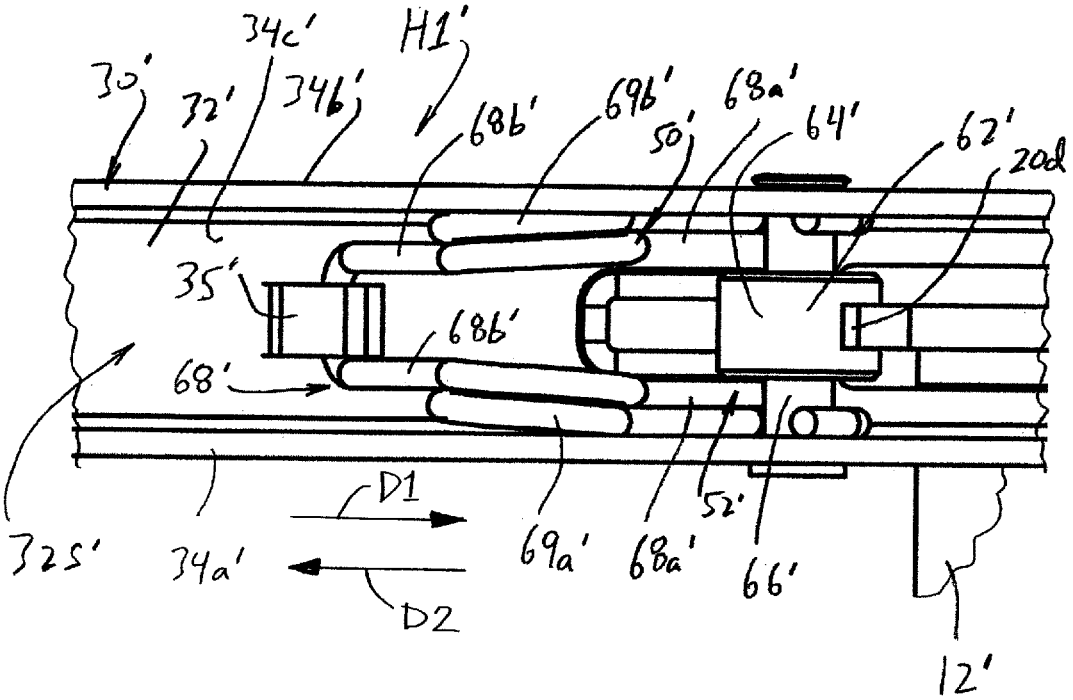
FIG. 8A is partial front view of the alternative blade hinge assembly of FIG. 8.

To open the appliance door D, manual opening force in an opening direction OD (FIG. 7C) is exerted on the door D by a human user to move the door D and door mounting lever 30 in the opening direction OD from the closed door (first operative) position (FIGS. 2 & 7C) toward the opened door (second operative) position (FIGS. 1 & 6A), and such manual opening force must be sufficient to move the roller 64 or other follower 62 out of the recess 20*a*, over the peak 20*c*, and into contact with the engagement surface 20*b* of the cam profile 20 against the biasing force of the spring-biased control system 50,50',50" (see FIG. 7B which shows a "peak position" where the follower 62 is in contact with the cam peak 20*c*). Due to the closing moment F1 as described above, and due to the presence of the peak 20*c*, the hinge assembly H1 is self-latching in its closed or first operative position such that the appliance door D does not require a separate latch to hold the door D in its closed position during use of the appliance which can provide various advantages in terms of parts and/or assembly cost, ease of service, reversibility of the door D as described above, improved aesthetics and user feel, and/or other advantages.

As the door D and door mounting lever 30 are moved further in the opening direction OD toward the door opened (second operative) position from the peak position of FIG. 7B, the follower 62 moves smoothly along the engagement surface 20*b* of the cam profile until the follower 62 reaches the engagement position (FIG. 7A) where the follower 62 is in contact with the engagement corner 20*d*. Further movement of the door D and lever 30 in the opening direction OD cause the follower 62 to separate from the cam profile 20 and the follower 62 is then biased to its normal, fully extended position as shown in FIG. 6A (referred to as the second operative position of the lever 30 and hinge assembly H1). Once the follower 62 separates from the cam profile 20, the door mounting lever 30 pivots or rotates freely relative to the mounting portion 10 in the opening direction OD without interference by or influence of the spring-biased cam follower system 50, 50',50" and the door D and lever 30 can be pivoted completely to the door opened position.

When the door D and door mounting lever 30 are manually pivoted by a user in a closing direction CD (FIG. 6A) from the door-opened position shown in FIGS. 1 & 6A toward the door-closed position, the lever 30 reaches an "engagement position" as shown in FIG. 7A where the roller 64 or other follower 62 makes initial contact with the engagement location 20*d* of the cam profile 20 (referred to as the engagement position of the lever 30 and hinge assembly H1). Further movement of the door D and lever 30 in the closing direction CD from the engagement position (FIG. 7A) toward the closed (first operative) position (FIG. 7C) causes the follower 62 to move along the engagement surface 20*b* of the cam profile 20 to the "peak position" (FIG. 7B) where the follower 62 is in contact with the peak 20*c* of the cam profile 20.

Further manual pivoting movement of the door D and lever 30 in the closing direction CD from the peak position forces the follower 62 over the peak 20*c* and into the closing recess 20 where the follower 62 engages the inclined surface 20*a*4 of the closing recess 20*a* as described above such that the lever 30 and hinge assembly H1 are in the first operative position corresponding to the closed position of the door D.

The development has been described with reference to preferred embodiments, but it is not intended that the invention be limited to only the preferred embodiments. The following claims should be interpreted as broadly as possible while maintaining their validity.

The invention claimed is:

1. A household appliance hinge assembly comprising:

a mounting portion comprising a base adapted to be connected to an appliance body and a mounting tab that projects outwardly from the base, said mounting tab comprising a peripheral edge and comprising a pivot aperture defined therein;

a cam profile defined in said peripheral edge;

a door mounting lever pivotally connected to the mounting tab of the mounting portion by a pivot fastener that is inserted in said pivot aperture of said mounting tab, wherein said door mounting lever pivots angularly and bi-directionally about a pivot axis in an opening direction and in an opposite closing direction and wherein said door mounting lever moves between a first operative position, a second operative position, and an engagement position located between said first operative position and said second operative position;

a spring-biased control system connected to said door mounting lever, said control system comprising a spring-biased cam follower system including a cam follower that: (i) engages said cam profile in said engagement position and for all positions of said door mounting lever between said engagement position and said first operative position; and, (ii) separates from said cam profile for all positions of said door mounting lever located between said engagement position and said second operative position.

2. The household appliance hinge as set forth in claim 1, wherein said cam follower is biased to an extended position when said door mounting lever is located between said second operative position and said engagement position.

3. The household appliance hinge as set forth in claim 1, wherein said spring-biased control system comprises:

a spring-rod slidably connected to the lever, wherein said follower is connected to an inner end of the spring rod;

a spring operatively engaged between the lever and the spring rod that biases said spring rod and said follower toward a fully extended position.

4. The household appliance hinge as set forth in claim 3, wherein said spring is coaxially positioned about said spring rod.

5. The household appliance hinge as set forth in claim 4, wherein said inner end of said spring rod comprises a bifurcated yoke including spaced-apart legs and wherein said follower comprises a roller located between said legs and rotatably secured to said legs by a follower support shaft.

6. The household appliance hinge as set forth in claim 5, wherein said lever comprises spaced-apart first and second side walls that respectively include first and second elongated slots that are aligned with each other, and wherein opposite first and second ends of the follower support shaft are located in said first and second elongated slots such that said roller is slidably supported relative to said lever.

7. The household appliance hinge as set forth in claim 1, wherein said lever comprises spaced-apart first and second side walls that respectively include first and second elongated slots that are aligned with each other, and wherein said follower is supported on a follower support shaft that includes opposite first and second ends that are respectively located in said first and second elongated slots such that said follower is movably connected to said lever.

8. The household appliance hinge as set forth in claim 7, wherein said spring-biased control system comprises a torsion spring comprising a first leg operatively engaged with said follower support shaft and a second leg operatively engaged with said lever such that said torsion spring biases said follower toward an extended position.

9. The household appliance hinge as set forth in claim 7, wherein said spring-biased control system comprises at least one coil spring operatively engaged between the pivot fastener and the follower support shaft such that said coil spring biases said follower toward an extended position.

10. The household appliance hinge as set forth in claim 1, wherein said cam profile comprises a concavely curved closing recess and an engagement surface that extends outwardly from said closing recess away from said base of said mounting portion.

11. The household appliance hinge as set forth in claim 10, wherein a peak is defined where an outer end of the closing recess intersects an inner end of the engagement surface.

12. The household appliance hinge as set forth in claim 11, wherein an outer end of said engagement surface defines an engagement corner that is contacted by said follower when said lever is located in said engagement position.

13. The household appliance hinge as set forth in claim 12, wherein said outer portion of said closing recess comprises an inclined surface that extends inwardly toward the base as it extends deeper into said closing recess toward a bottom of said closing recess, and wherein said follower is in contact with said inclined surface when said lever is pivoted to said first operative position such that said spring-biased control system induces a closing moment in the door mounting lever that urges said door mounting lever toward said first operative position.

14. A household appliance comprising:

a body;

a door pivotally connected to the body by first and second hinge assemblies, wherein at least one of the hinge assemblies comprises:

a mounting portion comprising a base connected to the appliance body and a mounting tab that projects outwardly from the base, said mounting tab comprising a peripheral edge and comprising a pivot aperture defined therein;

a cam profile defined in said peripheral edge;

a door mounting lever connected to said door, said door mounting lever pivotally connected to the mounting tab of the mounting portion by a pivot fastener that is inserted in said pivot aperture of said mounting tab, wherein said door mounting lever pivots angularly and bi-directionally about a pivot axis in an opening direction and in an opposite closing direction and wherein said door mounting lever moves between a first operative position corresponding to a closed position of the door, a second operative position corresponding to an opened position of the door, and an engagement position located between said first operative position and said second operative position;

a spring-biased control system connected to said door mounting lever, said control system comprising a spring-biased cam follower system including a cam follower that: (i) engages said cam profile in said engagement position and for all positions of said door mounting lever between said engagement position and said first operative position; and, (ii) separates from said cam profile for all positions of said door mounting lever located between said engagement position and said second operative position.

15. The household appliance as set forth in claim 14, wherein said cam follower is biased to an extended position when said door mounting lever is located between said second operative position and said engagement position.

16. The household appliance as set forth in claim 14, wherein said spring-biased control system comprises:

a spring-rod slidably connected to the lever, wherein said follower is connected to an inner end of the spring rod;

a spring operatively engaged between the lever and the spring rod that biases said spring rod and said follower toward a fully extended position.

17. The household appliance as set forth in claim 16, wherein said spring is coaxially positioned about said spring rod.

18. The household appliance as set forth in claim 17, wherein said inner end of said spring rod comprises a bifurcated yoke including spaced-apart legs and wherein said follower comprises a roller located between said legs and rotatably secured to said legs by a follower support shaft.

19. The household appliance as set forth in claim 18, wherein said lever comprises spaced-apart first and second side walls that respectively include first and second elongated slots that are aligned with each other, and wherein opposite first and second ends of the follower support shaft are located in said first and second elongated slots such that said roller is slidably supported relative to said lever.

20. The household appliance as set forth in claim 14, wherein said lever comprises spaced-apart first and second side walls that respectively include first and second elongated slots that are aligned with each other, and wherein said follower is supported on a follower support shaft that includes opposite first and second ends that are respectively located in said first and second elongated slots such that said follower is movably connected to said lever.

* * * * *